US006989050B2

(12) United States Patent
Ganeev et al.

(10) Patent No.: US 6,989,050 B2
(45) Date of Patent: Jan. 24, 2006

(54) DEVICE FOR ACCUMULATING AEROSOLS FROM GASES

(76) Inventors: Alexandr Akhatovich Ganeev, Home 93 Appartm.22 Leningradskaja Street, S-Petersburg, Pushkin 189620 (RU); Sergei Evgenievich Sholupov, Prospekt Koroleva Home 15/30 Appartm. 28, S-Petersburg 197341 (RU)

( * ) Notice: Subject to any disclaimer, the term of this patent is extended or adjusted under 35 U.S.C. 154(b) by 44 days.

(21) Appl. No.: 10/467,193

(22) PCT Filed: Jan. 29, 2002

(86) PCT No.: PCT/RU02/00028

§ 371 (c)(1),
(2), (4) Date: Aug. 5, 2003

(87) PCT Pub. No.: WO02/062481

PCT Pub. Date: Aug. 15, 2002

(65) Prior Publication Data

US 2004/0045442 A1 Mar. 11, 2004

(30) Foreign Application Priority Data

Feb. 8, 2001 (RU) ..... 2001104388

(51) Int. Cl.
*B03C 3/36* (2006.01)

(52) U.S. Cl. ..... 96/63; 55/DIG. 38; 96/94; 96/97

(58) Field of Classification Search ..... 96/63, 96/94, 97; 55/DIG. 38
See application file for complete search history.

(56) References Cited

U.S. PATENT DOCUMENTS

| | | | | | |
|---|---|---|---|---|---|
| 3,357,159 | A | * | 12/1967 | Drenning | 96/32 |
| 3,768,258 | A | * | 10/1973 | Smith et al. | 60/275 |
| 3,879,986 | A | * | 4/1975 | Sehmel | 73/28.04 |
| 3,957,374 | A | * | 5/1976 | Kriese et al. | 356/312 |
| 4,041,768 | A | | 8/1977 | Gibert et al. | 73/24.03 |
| 4,391,614 | A | * | 7/1983 | Rozmus | 95/28 |
| 4,670,026 | A | | 6/1987 | Hoenig | 95/73 |
| 5,217,510 | A | * | 6/1993 | Logan et al. | 96/15 |
| 5,656,063 | A | * | 8/1997 | Hsu | 95/58 |
| 5,667,563 | A | * | 9/1997 | Silva, Jr. | 96/50 |
| 5,948,141 | A | * | 9/1999 | Abdel-Rahman | 95/78 |

(Continued)

FOREIGN PATENT DOCUMENTS

DE 2717804 A1 3/1978

(Continued)

*Primary Examiner*—Richard L. Chiesa
(74) *Attorney, Agent, or Firm*—Christopher L. Parmelee; Walker & Jocke LPA

(57) ABSTRACT

An analytical instrument device is provided which can be used for analyzing industrial gas and air emissions. The device is operative to accumulate aerosols from gases and includes an atomizer connected to a gas pumping system, a needle, and a high-tension power supply. The atomizer includes a hollow cylinder provided with a dosing hole which is arranged in the central part of a lateral surface thereof. The gas pumping system includes a dosing hole of the atomizer with a needle arranged therein. The needle is provided with a movable platform for moving it in relation to the atomizer. An orthogonal system used for introducing the gas flow through the dosing hole of the atomizer makes it possible to essentially increase (by 6 times) a pumping speed and correspondingly to reduce the time of a sample accumulation.

1 Claim, 4 Drawing Sheets

U.S. PATENT DOCUMENTS

| | | | | | |
|---|---|---|---|---|---|
| 6,004,375 | A | * | 12/1999 | Gutsch et al. | 95/57 |
| 6,156,103 | A | * | 12/2000 | Abdel-Rahman | 96/64 |
| 6,436,170 | B1 | * | 8/2002 | McDermott et al. | 95/58 |
| 6,506,232 | B2 | * | 1/2003 | Menear | 95/59 |
| 6,508,982 | B1 | * | 1/2003 | Shoji | 422/22 |
| 6,585,803 | B1 | * | 7/2003 | Chang et al. | 95/70 |

FOREIGN PATENT DOCUMENTS

| | | | | | |
|---|---|---|---|---|---|
| FR | 2173660 | A | | 10/1973 | |
| JP | 5-161859 | | * | 6/1993 | 96/97 |
| RU | 927318 | A | | 5/1982 | |
| RU | 2072264 | C1 | | 1/1997 | |

* cited by examiner

DEVICE FOR ACCUMULATING AEROSOLS FROM GASES

TECHNICAL FIELD

The invention relates to analytical instrument-making engineering and may be used for analyzing different industrial gas and air emissions.

A device is known designed for accumulating aerosols from gases, including air, by means of their sedimentation on filters [1]. The device comprises a pump, a filter holder, a filter and an air flow rate meter. After gas is pumped through the filter, the latter filter is dissolved in a concentrated acid. The content of the accumulated elements in this solution is determined by means of one of the spectrum analysis methods (atomic absorption analysis, ICP ES, ICP MS, etc.). After subtracting of the background_(concentration) of the determining elements in the acid and filter material according to the known volumes of the solution and of the gas pumped-through, the content of the elements in aerosols is calculated in $\mu g/m^3$ or in $ng/m^3$.

BACKGROUND ART

A disadvantage of the device is a high content of the different elements in the filter material and acids (even in highly-purified acids). It requires pumping of the large gas volumes (>1 m3) through the filter, which results in a lot of time measured in hours for the sampling. The filter dissolution procedure lasts for quite a long time of 2–3 hours. As a result, this device capacity and efficiency is low. It is a known device for accumulating aerosols from the gases by means of their electrostatic precipitation on a tungsten rod, which is placed into an electrothermal atomizer after the accumulation of the aerosols. The device comprises a gas pump, a high-voltage source of an electric current and a Teflon pipe through which a gas is supplied. A sharpened tungsten electrode is inserted into this pipe wall and positive potential of 10 to 30 kV of is applied to this rod for the corona discharge excitation required for the precipitation of aerosols.

A disadvantage of the device is a partial precipitation of the aerosols on the rod, thus a calibration procedure with the help of an aerosol generator is required. However, it is a non adequate this procedure, since an actual distribution of the aerosol particles according to their dimensions in a sampling point and their composition may essentially differ from the standard one, thus inevitably producing significant and uncontrolled error. Furthermore, the precipitation efficiency remarkably reduces while in creasing the pumping rate, therefore it is necessary to employ relatively low rates of the flow for accumulation (about 1 to 1.5 l/min), since, taking into account low precipitation efficiency, time required for the accumulation is rather long,( i.e. about 30 to 60 minutes).

The functionally close device to the claimed one for accumulating aerosols from the gas comprises an atomizer (graphite furnace) with a transverse hole intended for resonance radiation transmission, a molybdenum needle inserted into the atomizer along its primary axis, a gas pumping system and a high-voltage source. The gas is pumped through the graphite furnace along its main axis. Corona discharge appearing on the atomizer axis at the needle tip becomes a source of the electrons attaching to the oxygen molecules, which precipitate on the aerosol particles accumulated on the atomizer walls.

Disadvantages of the known device are as follows:

1. Accumulation of the medium-volatile and hardly-volatile elements is impossible. Actually, employment of a molybdenum needle that is continuously inserted into the atomizer intended for corona discharge excitation will not permit use of an atomization temperature above 2300° C., otherwise the needle will be destroyed.
2. Relatively low gas pumping rate, i.e. no more than 1 l/min, typically for a coaxial pumping system. At a high pumping rate the precipitation efficiency becomes lower than <1, therefore, the pumping rate is increasing, will not reduce the time required for the aerosol accumulation, even making it last longer. Low pumping rate and low sensitivity (7 to 10 times less than for a standard method of the atomic absorption analysis with the electrothermal atomization) causes longer accumulation period of about 20 to 60 minutes.

DISCLOSURE OF INVENTION

The aim of the proposed invention is to increase the sampling efficiency and to reduce, the time of the sampling. This aim is achieved by means of that in the device for accumulating aerosols from gas, comprising an atomizer connected to gas pumping system, a needle and a high-voltage source, the atomizer is made in a form of a hollow cylinder with a dosing hole in the central part of its lateral surface, and the gas pumping system is provided with the atomizer dosing hole with the needle arranged in it and provided with a means for its mutual motion in relative to the atomizer.

An orthogonal system used for pumping the gas flow through a central dosing hole of the atomizer with symmetrically arranged ports has permitted to significantly improve the possibilities for accumulating the aerosols from the gases.

BRIEF DESCRIPTION OF DRAWINGS

Block diagram of the proposed device is given in FIG. 1. The relationship between the analytical signal Si and the volumetric pumping rate is shown in FIG. 2.

BEST MODES FOR CARRYING OUT INVENTION

Figure 1:
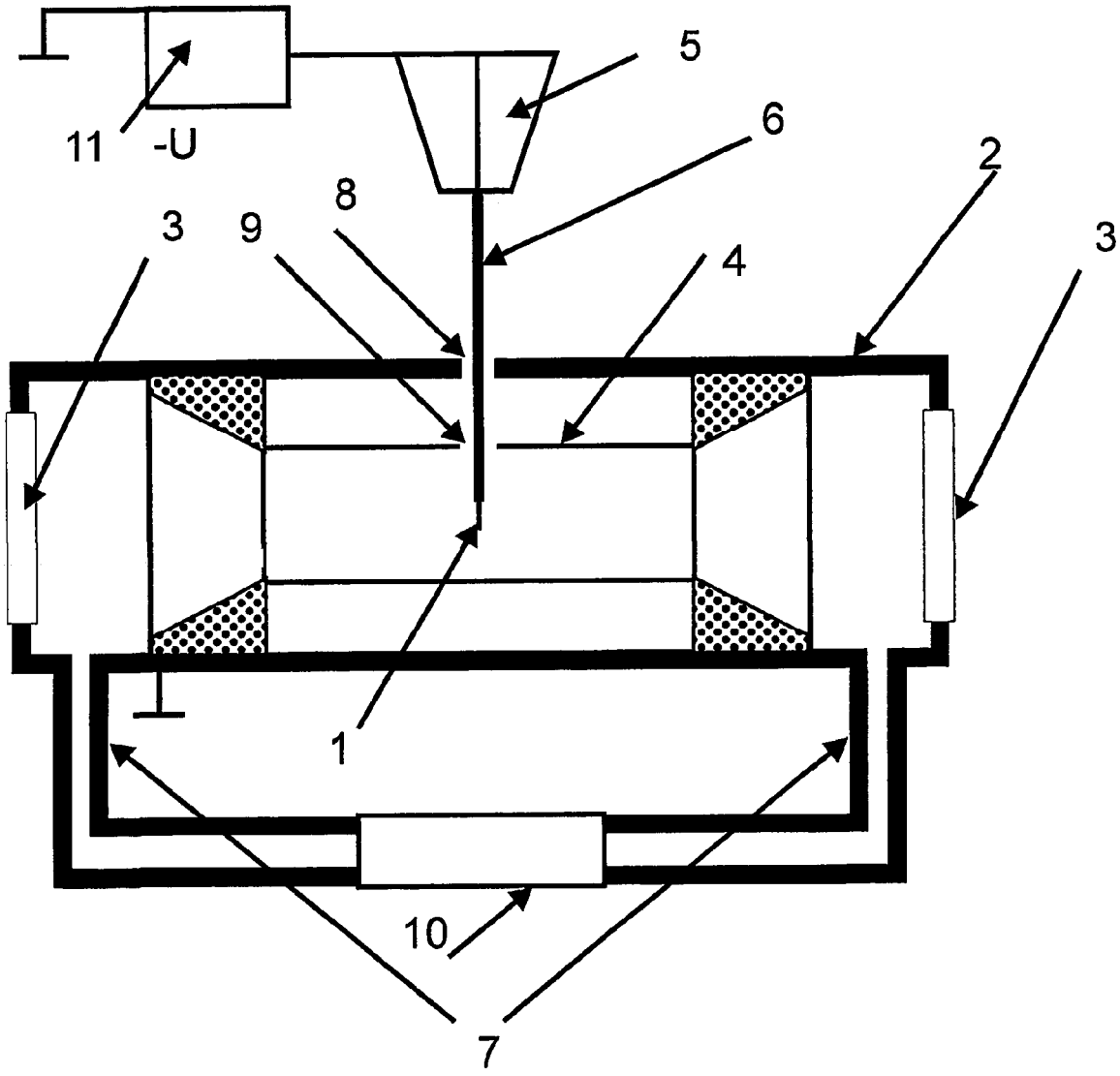

The proposed device provided in FIG. 1 comprises a needle 1, an atomizer casing 2, windows 3, an atomizer 4, a movable platform 5, a needle isolator 6, gas pumping ports 7, a hole in an atomizer casing cover 8, an atomizer dosing hole 9, a gas pump 10, a power supply 11.

The atomizer 4 is implemented as a hollow cylinder with the dosing hole 9 in the central part of its lateral surface. A standard Massman graphite furnace (electrothermal atomizer), as well as a thin-walled metallic hollow cathode (gas-discharge atomizer), can be used as the atomizer. Also, the other types of the atomizers may be used.

The gas pumping system comprises the gas pump 10 connected to the symmetrically arranged gas ports 7 and the atomizer dosing hole 9, wherein the needle 1 is located. Isolator 6 is designed to prevent the sparkling between lateral surface of the needle 1 and the wall of the atomizer dosing hole 9.

In this embodiment the movable platform 5, which restricts the needle to move in the perpendicular direction to the axis of the atomizer, serves as a means of the mutual motion of the needle and the atomizer.

The needle 1 should be made of a refractory metal, e.g. of molybdenum, otherwise the needle will be destroyed by a corona discharge during the operation in a short time.

The windows 3 are operative to be used in the atomic absorption analyzer.

The proposed device operates as follows:

Due to a negative pressure produced by the gas pump 10 in the atomizer casing 2, an analyzed gas is supplied through holes in the atomizer cover 8 and is pumped out through the ports 7. When a voltage is applied to the needle 1 (of about 2.2 to 2.8 kV), a corona discharge develops at its tip, and its electric current is regulated within 10 to 100 mA by means of a voltage variation. The corona discharge is a source of the electrons effectively attaching to the molecules of the oxygen, which also effectively precipitate at the aerosol particles. Since there is a high electric field intensity inside the atomizer 4, the aerosol particles drift to the atomizer wall and accumulate on it.

Prior to the atomizer replacement or carrying out the atomization procedure, the needle 1 is removed from the atomizer with the help of the movable platform 5.

For the illustrative sake we shall provide the results obtained with the help of the embodiment of the proposed device installed in a serial Zeeman atomic absorption spectrometer MGA-915.

The pumping rate was measured with electronic flow detectors. The flow rate varied from 2 up to 9 l/min by means of the gas pump supply voltage regulation.

The usage of orthogonal system for the gas pumping through the atomizer central dosing hole (in this embodiment it was a Massman furnace) with symmetrically arranged ports and a standard graphite furnace allowed improving the essential aerosols accumulation possibilities from the gases.

As it was mentioned above, the electrostatic precipitation of the aerosols is performed at low volumetric and linear gas flow rates, since the precipitation efficiency degradation enforces, while the flow rate is increased.

In current embodiment, the transverse configuration significantly differs from the traditional coaxial systems and it permits to realize the high pumping rates at high values of corona discharge electric current.

Figure 2:
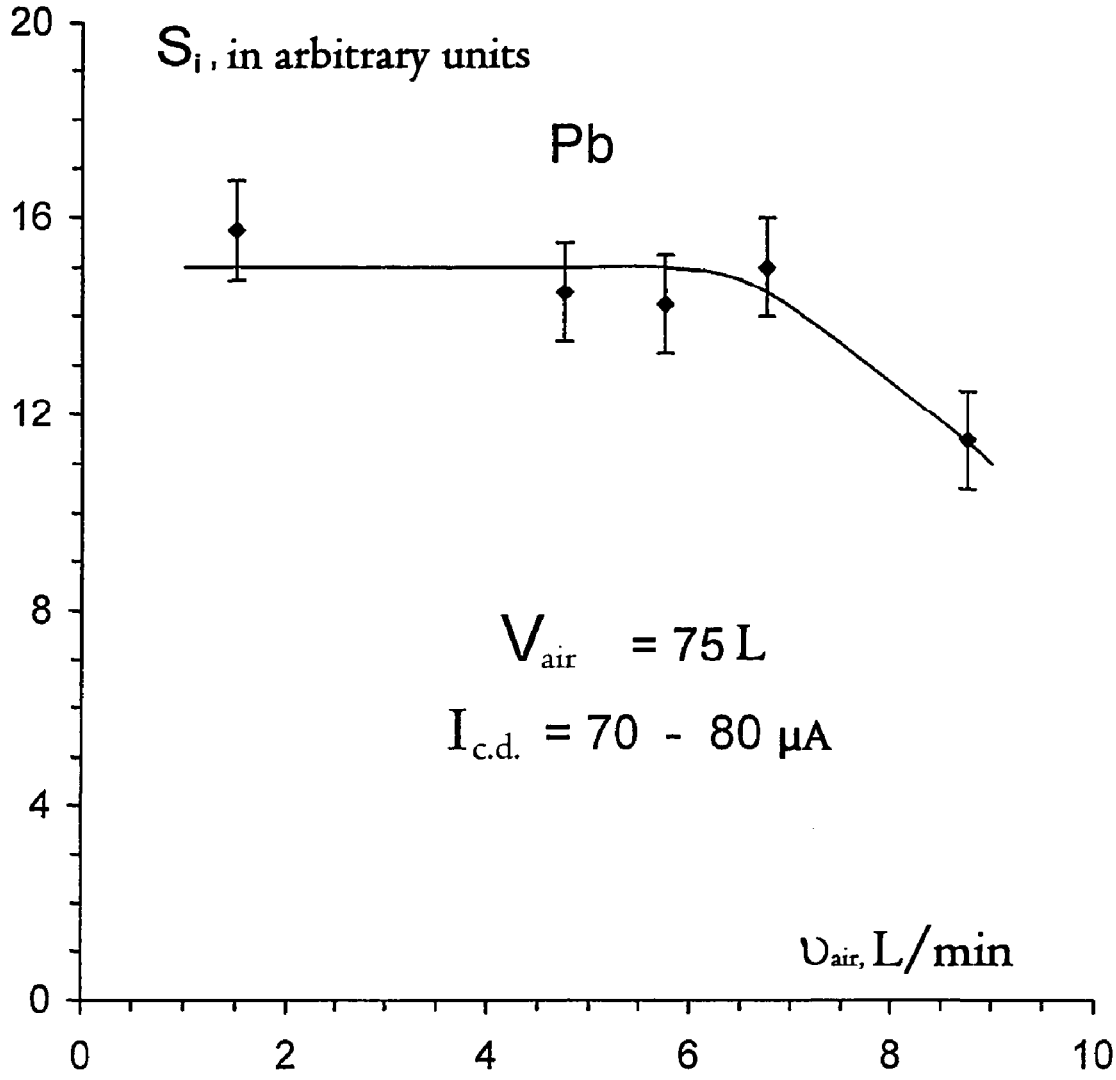

The determination of a lead content in the atmospheric air by means of the electrostatic precipitation method, the relationships between an analytic signal and a pumping rate and a corona discharge electric current have been analyzed. In FIG. 2 a relationship is given between the analytic signal $S_i$ and the volumetric gas (or air in this case) flow rate, where V is a pumped gas volume, which was the same for all $\upsilon$. As shown on the figure, the precipitation efficiency remains practically constant in a certain flow rate interval, and in this configuration the maximum flow rate is about 6 l/min. Signal reduction at high flow rates is primarily caused by a small particle precipitation efficiency degradation. Essential increase (in 6 times) of the maximum flow rate and, correspondingly, of the aerosol precipitate on efficiency is achieved due to a number of reasons:

1. By a pressure decrease in the graphite furnace in comparison to the atmospheric pressure, which increases the drift velocity of the charged aerosols to a furnace wall;
2. By a flow deceleration in the area below the dosing hole, that increases the aerosol precipitation efficiency;
3. By a flow clamping to the bottom part of the furnace, thus reducing time for a drift of the charged aerosols to a furnace wall.

Figure 3:
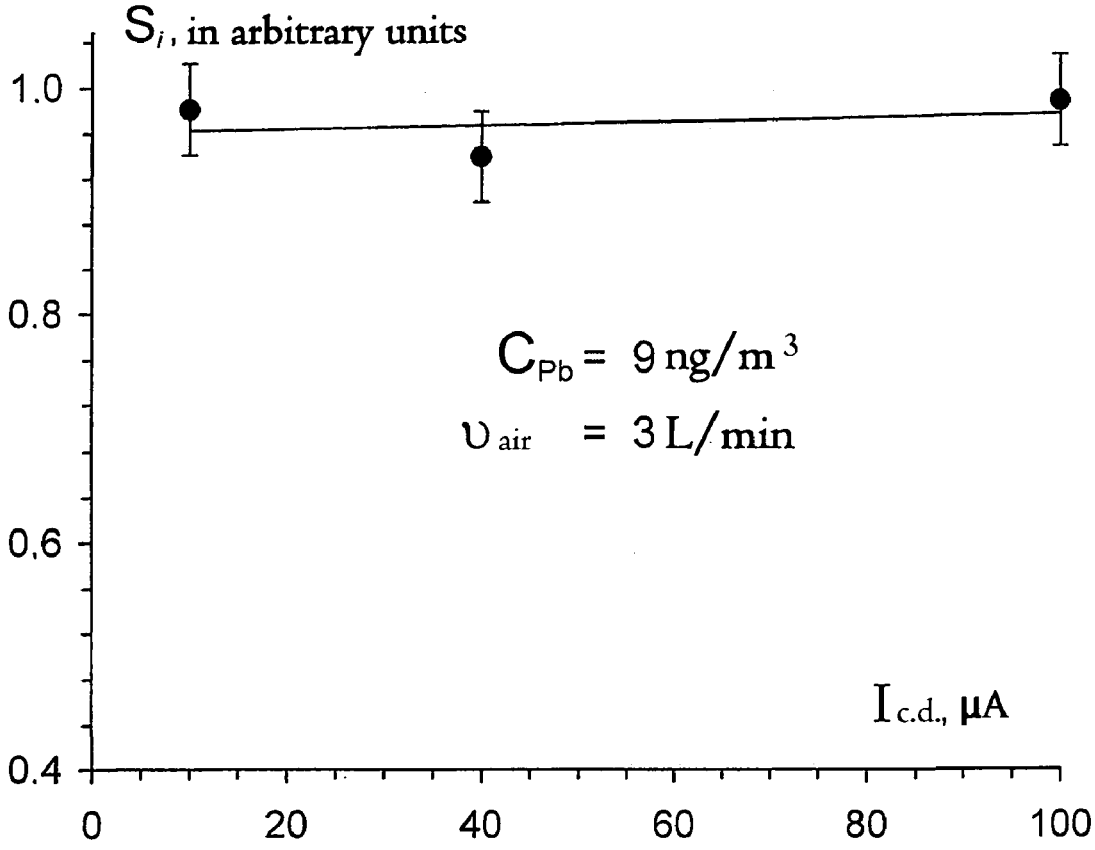
FIG. 3 provides a relationship between an analytical signal $S_i$ and an electric current of the corona discharge for a lead sample. The correspondence of the analytical signal $S_i$ and a pumped air volume is given in FIG. 4.

The obtained relationship between an analytic signal and a corona discharge electric current is shown in FIG. 3. As it can be seen from the figure, the signal remains constant within the range of an experimental error, while the current varies in a wide range indirectly confirming the data [3] on 100% precipitation efficiency of the aerosols at the corona discharge current of greater then 10 $\mu$A.

Figure 4:
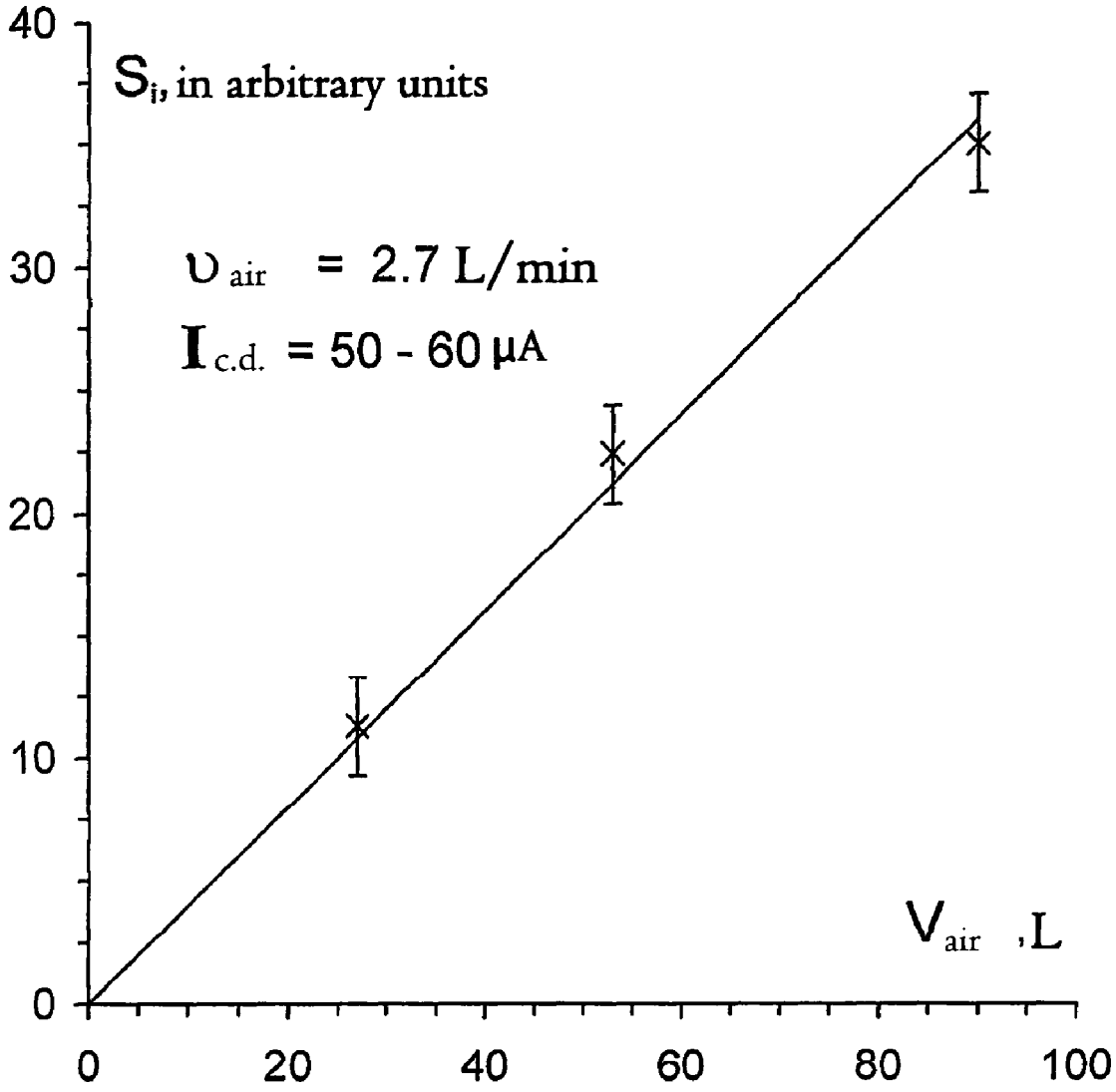

In FIG. 4 a relationship between the analytic signal $S_i$ and the volume of a pumped gas is given for a Pb obtained at an optimal mode ($\upsilon$=3 l/min, $I_{cd}$=30 $\mu$A). The signal values at each point were averaged over 3 measurements. As shown in FIG. 4, a good proportionality between $S_i$ and the pumped gas volume is observed. Lead concentrations in gas are determined during several days by means of electrostatic precipitation method were in the range of 20 to 60 $\mu$g/l, which coincide with the results given in references cited. The Pb concentration variations in other days may be explained by a fluctuation of the ambient air parameters: humidity, wind velocity and direction outdoors, as well as by works carried out in the room.

References:

1. Hitoshi M., Yoshinari A., Keiko S.//Atmos. Environ. 1990, V.24A, P. 1379–1390.
2. J. Sheddon Electrostatic Precipitation Atomic Absorption Spectrometry//Applied Spectroscopy, 1990, V.44, No.9, P.1562–1565.
3. G. Torsi and F. Palmisano. Spray Deposition versus Single-drop Deposition for Calibration of an Electrostatic Accumulation Furnace for Electrothermal Atomization Atomic Absorption Spectrometry//J. Analytical Atomic Spectrometry, 1987, V.22, P. 51–54.

What is claimed is:

1. A device for accumulating aerosols from gases, comprising an atomizer connected to a gas pumping system, a needle, a high-voltage source, wherein the atomizer is made in a form of a hollow cylinder with a dosing hole in the central part of its lateral surface and the gas pumping system is provided with the atomizer dosing hole with the needle arranged inside it and also provided with a means for a mutual motion relative to the atomizer.

* * * * *